United States Patent [19]

Terauchi

[11] Patent Number: 4,604,039

[45] Date of Patent: Aug. 5, 1986

[54] SCROLL TYPE FLUID COMPRESSOR WITH AXIAL CLEARANCE ADJUSTING CONSTRUCTION

[75] Inventor: Kiyoshi Terauchi, Isesaki, Japan

[73] Assignee: Sanden Corporation, Japan

[21] Appl. No.: 760,640

[22] Filed: Jul. 30, 1985

[30] Foreign Application Priority Data

Jul. 31, 1984 [JP] Japan ..... 59-158627

[51] Int. Cl.[4] ..... F04C 18/04; F04C 29/00

[52] U.S. Cl. ..... 418/55; 418/57; 418/107

[58] Field of Search ..... 418/55, 57, 107

[56] References Cited

U.S. PATENT DOCUMENTS 3,040,664 6/1962 Hartley .

3,924,977 12/1975 McCullough ..... 418/55

4,460,321 7/1984 Terauchi ..... 418/57

FOREIGN PATENT DOCUMENTS 122723 10/1984 European Pat. Off. ..... 418/57

55-64179 5/1980 Japan ..... 418/57

*Primary Examiner*—John J. Vrablik

*Attorney, Agent, or Firm*—Banner, Birch, McKie & Beckett

[57] ABSTRACT

The invention relates to scroll type fluid compressor which includes a mechanism for adjusting axial clearance and alignment. Adjustment sleeves, which are disposed threaded apertures of the compressor housing, move for and aft, and adjust the location and alignment of the scrolls. A threaded member passes through the sleeve to engage a threaded aperture on the end plate of the fixed scroll to thus fix the fixed scroll within the housing.

5 Claims, 2 Drawing Figures

SCROLL TYPE FLUID COMPRESSOR WITH AXIAL CLEARANCE ADJUSTING CONSTRUCTION

TECHNICAL FIELD

The present invention relates to a scroll type fluid compressor, in particular, to a scroll type fluid compressor which is easily and accurately adjustable and in which the scrolls can be properly aligned.

BACKGROUND OF THE INVENTION

When a scroll type fluid compressor is used, for example, as a compressor for an automotive air conditioning system, there is a need to produce relative high fluid pressures. However, the pressure tends to cause the pressurized fluid to leak from any clearance which may exist between the axial end surface of the scroll element of one scroll and the surface of the end plate of the other scroll. The leakage of the compressed fluid decreases the efficiency of the compressor.

It is known to try to minimize the axial clearance between scrolls by inserting a shim or shims in the assembly of a scroll type fluid compressor. However, it is difficult to get the correct combination of shims, exactly corresponding to the axial clearance between the scrolls of a particular compressor. Experimentation to find the right combination of shims also limits production speed in assembling a scroll compressor.

It is also known to adjust the axial clearance between scrolls by means of an adjusting screw fixed to the fixed scroll. However, in this type of structure, deflection of the fixed scroll may be caused by the particular location of the adjusting screw position. Also, this structure cannot correct alignment problems between the scrolls.

SUMMARY OF THE INVENTION

It is one object of the invention to provide a scroll type compressor with an improved axial clearance adjusting construction.

It is another object of the invention to provide a compressor with an improved axial clearance adjusting construction which also corrects the alignment between the scrolls.

It is another object of the invention to provide a scroll type compressor with an improved axial clearance adjusting and alignment mechanism which can be easily produced on a large scale.

The present invention is directed to a scroll type fluid compressor. The compressor includes a housing, a fixed scroll and an orbiting scroll. A fixed scroll is fixedly disposed in the housing and has a first circular end plate from which a first wrap extends into the interior of the housing. An orbiting scroll also has a second circular end plate from which a second wrap extends into the interior of the housing. The first and second wraps interfit at an angular and radial offset to form a plurality of line contacts to define at least one pair of sealed off fluid pockets. The fixed scroll end plate is provided a plurality of threaded apertures to adjustably fix the fixed scroll to the housing. The housing is provided with a plurality of complementary threaded apertures at a position corresponding to the threaded aperatures in the fixed scroll. Sleeves having external screw threads are inserted in each of the housing apertures to push against bosses on the rear side of the end plate of the fixed scroll to adjust the axial clearance between the scrolls and set the alignment. Screws pass through the sleeves to engage the threaded apertures in the end plate of the fixed scroll to adjustably fix the fixed scroll to the housing.

Further objects, features and other aspects of this invention will be understood from the detailed description of the preferred embodiments of this invention with reference to the annexed drawings.

DETAILED DESCRIPTION OF THE PREFERRED EMBODIMENT

Figure 1:
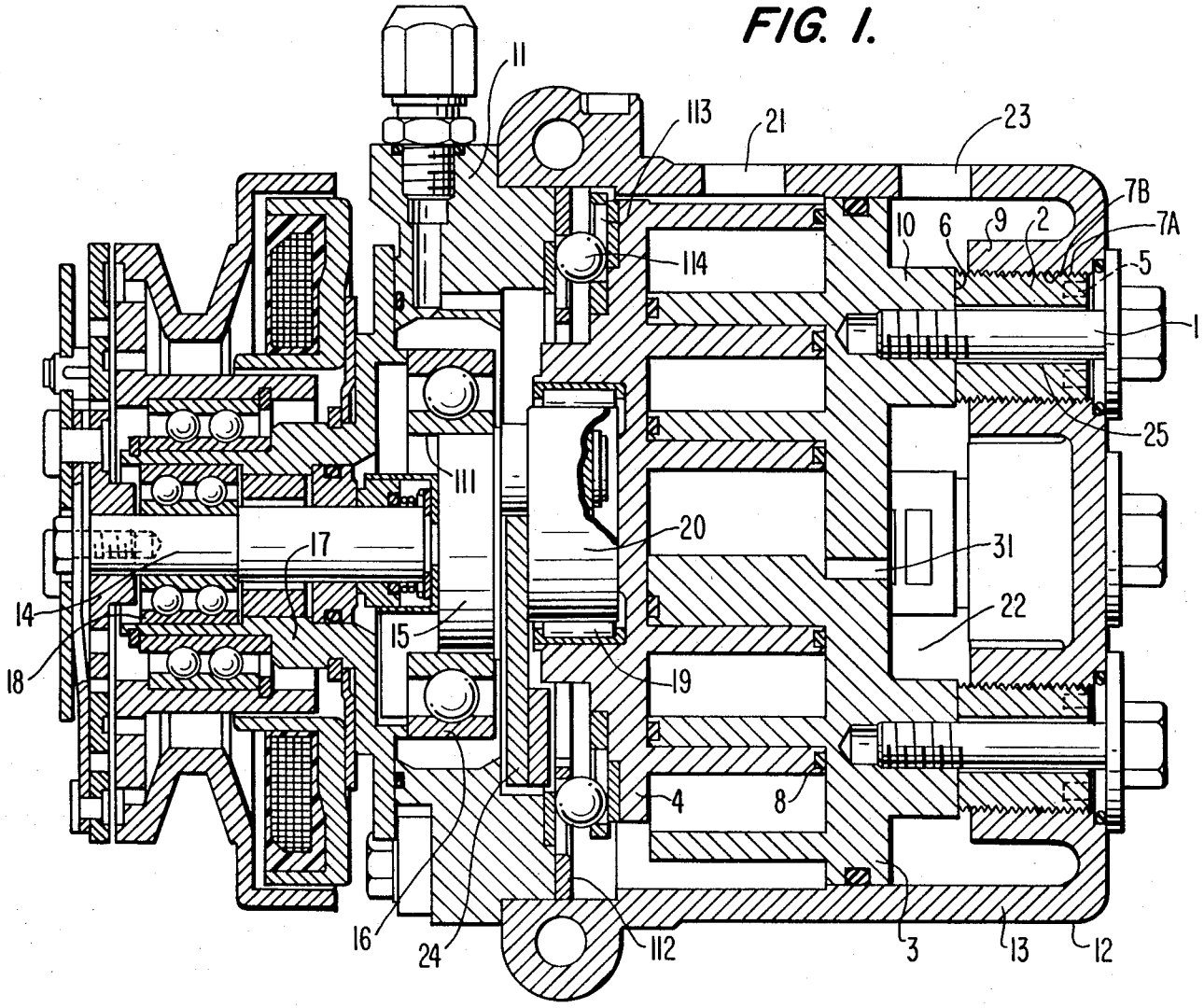
FIG. 1 is a vertical sectional view of a scroll type fluid compressor illustrating an embodiment of the invention.

Referring to the attached drawings, in FIG. 1, there is shown a scroll type fluid compressor with a housing 12 comprised of a front end plate 11 and cup shaped portion 13. Main drive shaft 14 extends into hole 111 in front end plate 11. A disk motor 15 is fixed to the inner end of main drive shaft 14, and is rotatably supported by a bearing 16 in hole 111.

Front end plate 11 has a sleeve 17 extending from it which surrounds main drive shaft 14. A bearing 18 is placed in the front end of sleeve 17 to rotatably support main drive shaft 14.

An orbiting scroll 4 is rotatably supported through a bearing 19 on a driving disk 20 eccentrically connected to the inner end surface of disk rotor 15. A half disk shaped counterweight 24 is coupled to the driving mechanism at a location between disk rotor 15 and driving disk 20, more specifically, counterweight is attached to driving disk 20. A fixed scroll 3 interfits with orbiting scroll 4 and the end plate of fixed scroll 3 is fixed to cup shaped portion 13, as will be further described below.

A rotation preventing mechanism, which prevents the rotation of orbiting scroll 4, is comprised of a fixed ring 112, an orbiting ring 113 and balls 114. Fixed ring 112 is fixed to front end plate 11, and orbiting ring 113 is fixed to the end plate of orbiting scroll 4 and faces fixed ring 112. Balls 114 set are placed between both rings and carried within ball receiving holes in each ring.

Fluid enters the compressor at a suction port 21 and flows into a closed space which is formed by orbiting scroll 4 and fixed scroll 3. The fluid is gradually compressed, moved to the center of the both scrolls by the orbital motion of orbiting scroll 4, discharged from output port 31 to discharge chamber 22, and exits from discharge port 23.

Fixed scroll 3 is attached to housing 12 by a screw 1. A screw thread 7B is formed on the inner surface of an apertured boss 9 of housing 12. A sleeve 2, having external screw threads 7A, is threaded into apertured boss 9. Holes 5 are formed at the outer end portion of sleeve 2 to facilitate inserting sleeve 2 in apertured boss 9, as will be explained below. A plurality of apertured bosses 10 project from the rear side of the end plate of fixed scroll 3. The interior surface of each boss 10 has screw threads as shown in FIG. 2.

Figure 2:
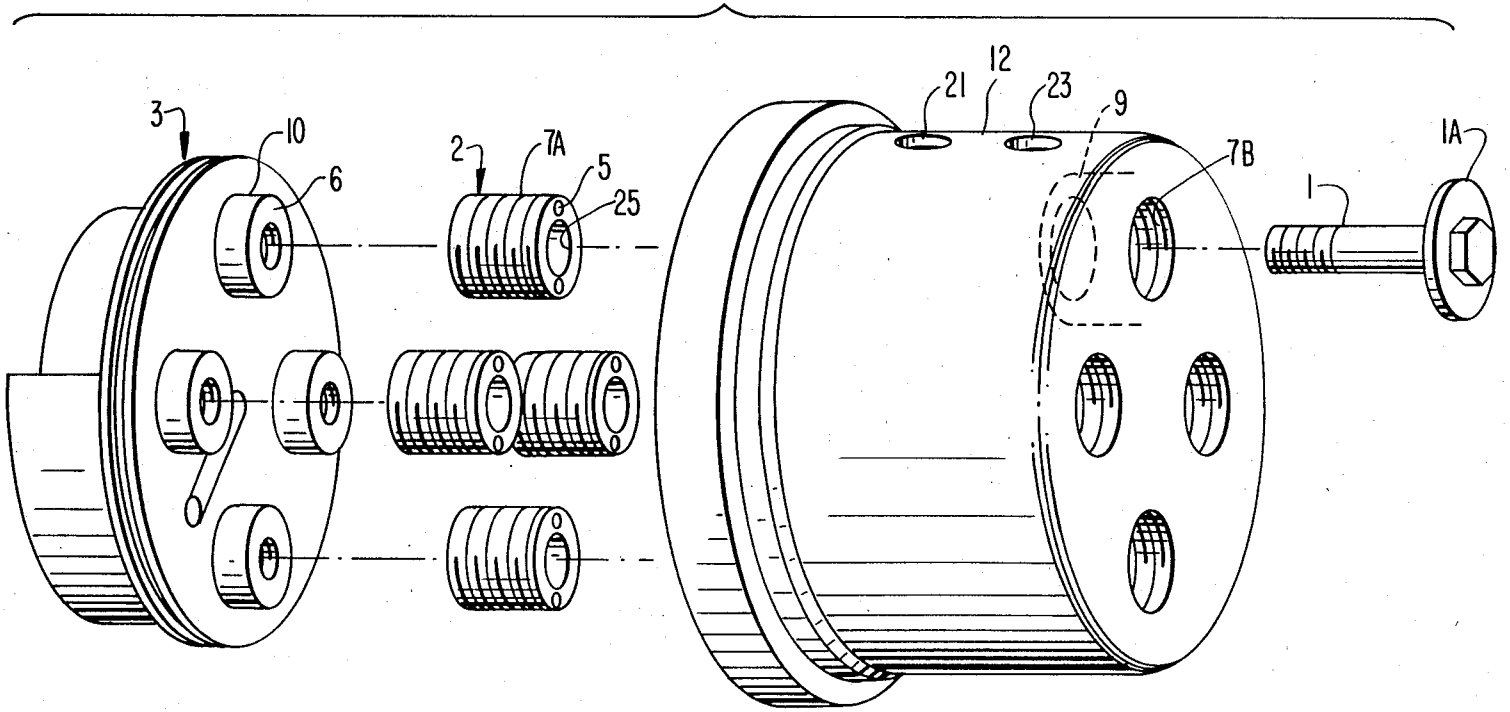
FIG. 2 is an exploded perspective view illustrating the adjusting mechanism portion of the invention.

Referring to FIG. 2, the procedure for adjusting the axial clearance and alignment of the scrolls in accordance with the present invention will be described.

Sleeve 2 is threaded into the opening of boss 9. In order to thread sleeve 2 into boss 9, sleeve 2 is rotated from the outside of housing 12 by a jig, which is hooked to holes 5 of sleeve 2. Sleeve 2 is axially moved into boss 9 until the inner end of sleeve 2 pushes against hardened surface 6 of boss 10 on the end plate of fixed scroll 3. Fixed scroll 3 is thus adjustably forced against orbiting scroll 4.

It is possible to select the relevant value of the axial force which pushes fixed scroll 3 against orbiting scroll 4 through hardened surface 6 of boss 10 by controlling the extent by which sleeve 2 projects from boss 9. When properly adjusted, the end surface of the scroll element of fixed scroll 3 engages completely the inner surface of the end plate of orbiting scroll 4.

Screw 1 passes through a hole 25 of sleeve 2 and is threaded into boss 10 of fixed scroll 3. Thus, fixed scroll 3 is attached to housing 12. Using the above construction, it is possible to assemble a scroll compressor without any axial clearance between the scrolls.

Furthermore, even though the assembly of parts may result in a misalignment between the scrolls, i.e., the end plates not being parallel, this misalignment can be eliminated by properly adjusting and aligning the scrolls with adjustable sleeves 2.

This invention has been described in detail in connection with a preferred embodiment. This embodiment, however, is merely for example only and the invention is not restricted thereto. It will be easily understood by those skilled in the art that other variations and modifications can easily be made within the scope of the invention, as defined by the appended claims.

I claim:

1. A scroll type fluid compressor comprising:

a housing;

a fixed scroll fixedly disposed within said housing and having a first circular end plate from which a first wrap extends into the interior of said housing;

an orbiting scroll having a second circular end plate from which a second wrap extends, said first and second wraps interfitting at an angular and radial offset to form a plurality of line contacts which define at least one pair of sealed off fluid pockets;

said first end plate having a plurality of first threaded apertures facing said housing to adjustably fix said first end plate to said housing;

said housing having a plurality of second threaded apertures corresponding in number and position to said first apertures;

a sleeve having external screw threads adjustably threaded into each of said second threaded apertures so that the inner end surface of said sleeves presses against said first end plate to adjust the axial clearance between both said scrolls; and a threaded member passing through said sleeves and threadedly fixed to said first threaded apertures, so that said fixed scroll is adjustably fixed within said housing.

2. The scroll type fluid compressor as recited in claim 1 wherein said sleeves each have a plurality of holes on their outer end surface to facilitate insertion of said sleeves in said second threaded apertures.

3. A scroll type fluid compressor as recited in claim 1 wherein said housing has a plurality of housing bosses projecting inwardly from its inside surface and said second threaded apertures are formed in said housing bosses.

4. A scroll type fluid compressor as recited in claim 3 wherein said end plate of said fixed scroll has a plurality of outwardly projecting end plate bosses and first threaded apertures are formed in said end plate bosses.

5. A scroll type fluid compressor as recited in claim 4 wherein said inner end surface of said sleeve presses against said end plate bosses.

* * * * *